US009651309B2

(12) United States Patent
Gärdin

(10) Patent No.: US 9,651,309 B2
(45) Date of Patent: May 16, 2017

(54) PRESSING ARRANGEMENT

(75) Inventor: Mats Gärdin, Vasteras (SE)

(73) Assignee: Quintus Technologies AB, Vasteras (SE)

( * ) Notice: Subject to any disclaimer, the term of this patent is extended or adjusted under 35 U.S.C. 154(b) by 338 days.

(21) Appl. No.: 13/978,188

(22) PCT Filed: Jan. 3, 2011

(86) PCT No.: PCT/EP2011/050028

§ 371 (c)(1),
(2), (4) Date: Sep. 9, 2013

(87) PCT Pub. No.: WO2012/092961

PCT Pub. Date: Jul. 12, 2012

(65) Prior Publication Data

US 2013/0337395 A1 Dec. 19, 2013

(51) Int. Cl.
*F27D 7/06* (2006.01)
*B22F 3/00* (2006.01)
(Continued)

(52) U.S. Cl.
CPC ..... *F27D 7/06* (2013.01); *B22F 3/003* (2013.01); *B30B 11/002* (2013.01);
(Continued)

(58) Field of Classification Search
CPC ..... B30B 11/002; B30B 11/001; B30B 15/34; B22F 3/15; B22F 2003/153; F27B 17/0083; B28B 3/003
(Continued)

(56) References Cited

U.S. PATENT DOCUMENTS 3,571,850 A 3/1971 Pohto et al.
4,235,592 A 11/1980 Smith, Jr. et al.
(Continued)

FOREIGN PATENT DOCUMENTS

CN 101257990 9/2008
CN 101347837 1/2009
(Continued)

*Primary Examiner* — Steven B McAllister
*Assistant Examiner* — Ko-Wei Lin
(74) *Attorney, Agent, or Firm* — Allen, Dyer, Doppelt & Gilchrist

(57) ABSTRACT

The present invention relates to an arrangement for treatment of articles by hot pressing. The pressing arrangement for treatment of articles by hot pressing comprises a pressure vessel including: a furnace chamber comprising a heat insulated casing and a furnace adapted to hold the articles. A heat exchanger unit is arranged below said furnace chamber and adapted to exchange thermal energy with pressure medium when the pressure medium is passing through said heat exchanger unit. According to the present invention, at least one first and second inlet or aperture, respectively, for passage of alternating warm and cold pressure medium are arranged in the heat insulated casing in proximity to the heat exchanger unit (i.e. at approximately same the height as, above or below the heat exchanger unit). The at least one second inlet (or lower inlet) is below the at least one first inlet (or upper inlet) but at same height as or below the heat exchanger unit.

12 Claims, 8 Drawing Sheets

(51) Int. Cl.

| | |
|---|---|
| ***B30B 11/00*** | (2006.01) |
| ***F27B 17/00*** | (2006.01) |
| ***F27D 1/12*** | (2006.01) |
| ***F27D 7/04*** | (2006.01) |
| ***F27D 9/00*** | (2006.01) |

(52) U.S. Cl.
CPC ..... *F27B 17/0083* (2013.01); *F27D 1/12* (2013.01); *F27D 7/04* (2013.01); *F27D 9/00* (2013.01)

(58) Field of Classification Search
USPC ..... 425/405.2, 405.1
See application file for complete search history.

(56) References Cited

U.S. PATENT DOCUMENTS

| | | | | |
|---|---|---|---|---|
| 4,246,957 | A | 1/1981 | Smith, Jr. et al. | |
| 4,268,708 | A | 5/1981 | Smith, Jr. et al. | |
| 4,280,807 | A | 7/1981 | Smith, Jr. et al. | |
| 4,532,984 | A | 8/1985 | Smith, Jr. | |
| 2006/0201221 | A1* | 9/2006 | Sehlstedt | B22F 3/15 72/201 |

FOREIGN PATENT DOCUMENTS

| | | | |
|---|---|---|---|
| EP | 0185947 | 11/1985 | |
| EP | 0170728 | 12/1986 | |
| EP | 0395884 | 11/1990 | |
| JP | 54134532 | 9/1979 | |
| JP | 63-41786 | 2/1988 | |
| RU | 2245221 | 1/2005 | |
| RU | 2302924 | 7/2007 | |
| SE | 465358 | 9/1991 | |
| SE | 467611 | 8/1992 | |
| SE | 0300595 | 9/2004 | |
| WO | 2009/076973 | 6/2009 | |
| WO | 2009076973 | 6/2009 | |
| WO | WO 2009076973 A1 * | 6/2009 | B30B 11/00 |

* cited by examiner

PRESSING ARRANGEMENT

TECHNICAL FIELD OF THE INVENTION

The present invention relates to an arrangement for treatment of articles by hot pressing, and preferably hot isostatic pressing, and to treatment of articles by hot pressing.

BACKGROUND OF THE INVENTION

Hot isostatic pressing (HIP) is a technology that finds more and more widespread use. Hot isostatic pressing is for instance used in achieving elimination of porosity in castings, such as for instance turbine blades, in order to substantially increase their service life and strength, in particular the fatigue strength. Another field of application is the manufacture of products, which are required to be fully dense and to have pore-free surfaces, by means of compressing powder.

In hot isostatic pressing, an article to be subjected to treatment by pressing is positioned in a load compartment of an insulated pressure vessel. A cycle, or treatment cycle, comprises the steps of: loading, treatment and unloading of articles, and the overall duration of the cycle is herein referred to as the cycle time. The treatment may, in turn, be divided into several portions, or phases, such as a pressing phase, a heating phase, and a cooling phase.

After loading, the vessel is sealed off and a pressure medium is introduced into the pressure vessel and the load compartment thereof. The pressure and temperature of the pressure medium is then increased, such that the article is subjected to an increased pressure and an increased temperature during a selected period of time. The temperature increase of the pressure medium, and thereby of the articles, is provided by means of a heating element or furnace arranged in a furnace chamber of the pressure vessel. The pressures, temperatures and treatment times are of course dependent on many factors, such as the material properties of the treated article, the field of application, and required quality of the treated article. The pressures and temperatures in hot isostatic pressing may typically range from 200 to 5000 bars, and preferably from 800 to 2000 bars and from 300 to 3000° C., and preferably from 800° C. to 2000° C., respectively.

When the pressing of the articles is finished, the articles often need to be cooled before being removed, or unloaded, from the pressure vessel. In many kinds of metallurgical treatment, the cooling rate will affect the metallurgical properties. For example, thermal stress (or temperature stress) and grain growth should be minimized in order to obtain a high quality material. Thus, it is desired to cool the material homogeneously and, if possible, to control the cooling rate. Many presses known in the art suffer from slow cooling of the articles, efforts have therefore been made to reduce the cooling time of the articles.

In U.S. Pat. No. 5,118,289, there is provided a hot isostatic press adapted to rapidly cool the articles after completed pressing and heating treatment. The press comprises a pressure vessel, having an outer wall, end closures, and a hot zone surrounded by thermal barriers. The outer wall of the pressure vessel is cooled from the outside. The hot zone is arranged to receive articles to be treated. Between the thermal barriers and the pressure vessel with end closures, there are colder spaces, or zones. As in conventional hot isostatic presses, the pressure medium is heated during pressing of the articles, which are placed in the hot zone as mentioned above.

Further, in the press disclosed in U.S. Pat. No. 5,118,289, during cooling of the articles, cooled pressure medium is introduced into the hot zone, whereby thermal energy is transferred from the articles to the pressure medium. Thus, the temperature of the pressure medium will increase during the passage through the hot zone and the temperature of the articles will decrease. When leaving the hot zone, the relatively hot pressure medium will reach the walls of the pressure vessel. In a conventional hot isostatic press, the amount of hot pressure medium reaching the walls of pressure vessel must be carefully controlled in order not to overheat the walls of the pressure vessel, i.e. every interior surface of the press coming in contact with the hot pressure medium. This means that the cooling must be performed at a relatively slow pace, i.e. not faster than the pressure vessel can withstand over time.

The press in the above mentioned U.S. Pat. No. 5,118,289, however, further comprises a heat exchanger, which is located above the hot zone, in order be able to decrease the time for cooling of articles. Thereby, the pressure medium will be cooled by the heat exchanger before it makes contact with the pressure vessel wall. Consequently, the heat exchanger allows for an increased cooling capacity without the risk of overheating the wall of the pressure vessel. Further, as in conventional hot isostatic presses, the pressure medium is cooled when passing through a gap between the pressure vessel wall and the thermal barriers during cooling of articles. When the cooled pressure medium reaches the bottom of the pressure vessel, it re-enters the hot zone (in which the articles to be cooled are located) via a passage through the thermal barrier.

The heat exchanger becomes hot during cooling of the pressure medium and the articles, and, in order to function as a booster during the cooling of articles, the heat exchanger must be cooled before the press may be operated to treat a new set of articles. Thus, a drawback of this type of press is that the time between subsequent cycles is dependent on the cooling time of the heat exchanger. In order to overcome this problem, one approach is to employ two heat exchangers. With two heat exchangers, one heat exchanger may be cooled outside the hot isostatic press, while the other is used in the hot isostatic pressing procedure. However, this results in the drawback of having to exchange the heat exchangers before each pressing operation. Additionally, the use of two heat exchangers, of course, increases costs for the pressing arrangement.

SUMMARY OF THE INVENTION

A general object of the present invention is to provide an improved pressing arrangement, which eliminates or at least reduces at least one of the above mentioned problems.

In particular, it is an object of the present invention to provide a pressing arrangement and method for such an arrangement capable of rapid cooling at a low thermal load on the pressure vessel.

Another object of the present invention is to provide a pressing arrangement and method for such an arrangement capable of rapid cooling at a low thermal load on the pressure vessel without any additional moving parts such as valves.

It is a further object of the present invention to provide a compact and cost efficient design of a pressing arrangement capable of rapid cooling.

It is yet another object of the present invention to provide a robust design of a pressing arrangement capable of rapid cooling.

These and other objects of the present invention are achieved by means of a pressure vessel and method for such vessel having the features defined in the independent claims. Embodiments of the present invention are characterized in the dependent claims.

In the context of the present invention, the terms "cold" and "hot" or "warm" (e.g. cold and warm or hot pressure medium or cold and warm or hot temperature) should be interpreted in a sense of average temperature within the pressure vessel. Similarly, the term "low" and "high" temperature should also be interpreted in a sense of average temperature within the pressure vessel.

Furthermore, in the context of the present invention, the term "heat exchanger unit" refers to a unit capable of storing thermal energy and exchanging thermal energy with the surrounding environment.

According to a first aspect of the invention, there is provided a pressing arrangement for treatment of articles by hot pressing, comprising: a pressure vessel including: a furnace chamber comprising a heat insulated casing and a furnace adapted to hold the articles. A heat exchanger unit is arranged below the furnace chamber and adapted to exchange thermal energy with pressure medium when the pressure medium is passing through the heat exchanger unit. According to the present invention, at least one first and second inlet or aperture, respectively, for passage of alternating warm and cold pressure medium are arranged in the heat insulated casing in proximity to the heat exchanger unit (i.e. at approximately same the height as, above or below the heat exchanger unit). The at least one second inlet (or lower inlet) is below the at least one first inlet (or upper inlet) but at same height as or below the heat exchanger unit.

The pressing arrangement according to the present invention is advantageously used for hot isostatic pressing in connection with treatment of articles.

Generally, to achieve cooling within the pressure vessel and of the articles being treated within the pressure vessel, pressure medium is circulated through the furnace chamber and a cooler region of the pressure vessel, such as the intermediate space outside the furnace chamber. Thus, while the amount of pressure medium contained in the furnace chamber is approximately constant, there is a positive net flow of heat away from the articles in the furnace chamber.

The present invention is on an overall level concerned with how to enhance and speed up this cooling course. More specifically, the present invention is based on the idea of arranging a heat exchanger unit for cooling of the pressure medium in the region of the pressure vessel below the furnace to achieve a more rapid and efficient cooling process. More specifically, the invention is based on the insight that the pressure medium itself can be used to cool the heat exchanger unit during, for example, steady-state phases of the operation cycle, and that the heat exchanger unit thereby in a very efficient way can be used to cool down the pressure medium during a rapid cooling process. This is achieved by co-operation between the upper and lower inlet, or inlets, and the heat exchanger unit and the relative locations of these elements or parts inside the pressure vessel. Further, this is achieved without involving valves including moving parts or similar devices and without feeding the heat exchanger unit with external cooling medium.

If the heat exchanger unit instead is placed in a warmer region of the vessel, for example, above the furnace, the ascending or rising heat will tend to warm the heat exchanger unit to some extent. By arranging the heat exchanger unit in a cooler region of the vessel (i.e. below the furnace), an undesired warming of the heat exchanger unit during e.g. feeding of pressure medium and increasing the temperature or during the pressing phase and steady-state can be avoided. That is, undesired warming of the heat exchanger unit can be avoided during other phases than the actual cooling phase when the heat exchanger unit is utilized for transferring heat or thermal energy from the pressure medium to the heat exchanger unit. The cooling of the pressure medium will thus be very efficient and rapid due to the fact that the heat exchanger unit can be kept at a low temperature until the cooling phase is initiated.

This is generally realized by means of arranging the heat exchanger unit inside the pressure vessel and below the furnace chamber, where the heat exchanger unit may exchange thermal energy with the pressure medium. Then, the heat exchanger unit may be exposed to colder portions of pressure medium, which due to differences in density between hotter and colder portions, will strive downwards in the pressure vessel to the bottom thereof. Thus, instead of arranging the heat exchanger unit above the furnace chamber, where the pressure medium can be expected to be hotter than in the lower portion of the vessel, the heat exchanger unit is arranged below the furnace chamber, where the pressure medium can be expected to be colder. Thereby, the colder pressure medium itself may be used for reducing the temperature of the heat exchanger unit during the cycle.

During steady-state or, for example, during the heating and pressing phase of the cycle, relatively cold pressure medium will be transported through the heat exchanger unit and heat (or thermal energy) is transferred from the heat exchanger unit to the pressure medium or the heat exchanger unit is kept at cold condition depending on the relative temperature conditions between the transported pressure medium and the heat exchanger unit. The pressure medium streaming upwards in these phases will flow through the upper and lower inlets and further upwards. In other words, a cooling convection loop is created during the steady-state and heating phases.

If a moderate cooling process is desired, the pressure medium will flow as described above but there will also be a flow of warm pressure medium downwards through the upper inlets from the furnace. Thus, the heat exchanger unit will not be warmed during such moderate cooling. However, if a faster cooling is desired, the flow of the warm pressure medium from the furnace will be so high that the upper inlets will be saturated, which entails that warm pressure medium also is forced downwards through the heat exchanger unit. Heat (or thermal energy) will be transferred from the pressure medium to the heat exchanger unit. The cooled pressure medium then returns upwards through the lower inlets. Due to the fact that the heat exchanger unit has been kept cold (in relative terms) during steady-state, moderate cooling, or during pressing of articles, an efficient and significant heat transfer between the downward streaming pressure medium and the heat exchanger can be achieved. By means of the present invention, a significant amount of thermal energy can be transferred to the heat exchanger unit from the pressure medium hence reducing the amount of thermal energy that has to be transferred to the walls of the vessel in order to reach a predetermined temperature change rate of the load (articles) or the pressure medium. In other words, it is possible to rapidly reach a desired temperature without thermally overloading the vessel walls in a controlled manner.

When the cooling is interrupted, for example, when a desired temperature has been reached of the load or the pressure medium, the convection process can be used to cool down the heat exchanger unit again. Thus, thermal energy is dissipated from the heat exchanger unit to colder pressure medium flowing through the element.

In this manner, the present invention also provides the advantage of significantly facilitating the operation of the pressing arrangement, since the exchanger does not need to be moved or replaced between cycles.

In addition, the costs for the pressing arrangement may be reduced due to the fact that only one heat exchanger needs to be employed for one pressing arrangement.

Due to the upper and lower inlet, respectively, or set of inlets, the rapid cooling can be achieved without any additional valves including movable parts for the heat exchanger, which entails that the construction of the cooling means can be made relatively simple and robust.

The careful design and arrangement of upper and lower inlet, respectively or sets of inlets and the arrangement of the heat exchanger unit cooperate to create an efficient pumping effect through the heat exchanger unit during the different phases, for example, during cooling of the heat exchanger unit. If the heat exchanger unit is warm, i.e. warmer than the pressure medium entering from below, the pumping effect will be powerful and vice versa.

In order for the walls of the pressure vessel to sustain the high temperatures and pressures of the hot isostatic pressing process, the hot isostatic press is preferably provided with means for cooling the pressure vessel. For instance, the means for cooling may be a coolant, such as water. The coolant may be arranged to flow along the outer wall of the pressure vessel in a pipe system, or cooling channels, in order to keep the wall temperature at a suitable level.

Further, the heat insulated casing of the furnace chamber comprises a bottom insulating portion and the heat exchanger unit is located below the bottom insulating portion of the casing. Consequently, the heat exchanger unit is separated and thermally insulated from the articles within the furnace chamber. Thereby, a hot zone within the furnace chamber is effectively insulated from a cold zone in the lower portion of the hot isostatic pressing arrangement.

When the pressure medium is brought into contact with the pressure vessel wall, thermal energy is exchanged between the pressure medium and the wall, which may be cooled by a coolant from the outside of the pressure vessel. In this manner, the pressing arrangement is, advantageously, arranged to circulate the pressure medium within the pressure vessel, thereby creating an outer, passive convection loop. The purpose of the outer convection loop is to enable cooling of the pressure medium during cooling of the articles and to enable cooling of the heat exchanger unit during heating of the articles. This makes it possible to cool the heat exchanger unit during pressing and heating of the articles. That is, thermal heat is transferred from the pressure medium to the heat exchanger unit during cooling of articles and from the heat exchanger unit to the pressure medium during pressing and heating of articles. In this manner, the cycle time may be reduced, since after cooling of the articles the press may be immediately operated to press and heat a new set of articles.

The hot isostatic pressing arrangement may also comprise a flow generator, located beneath the furnace chamber in the vicinity of the heat exchanger unit. The flow generator enhances circulation of the pressure medium within the pressure vessel, i.e. in the outer convection loop. The flow generator may, for example, be in the form of a fan, a pump, an ejector, or the like.

The furnace chamber comprises a guiding passage formed between the heat insulated casing of the furnace chamber and the load compartment. There may be located a further flow generator within the furnace chamber for enhancing the circulation of the pressure medium therein, thereby creating an even temperature distribution. The flow generator will force the pressure medium upwards through the load compartment and downwards through the further guiding passage. As a result, an inner, active convection loop is created. The further flow generator, such as a fan, a pump, an ejector, or the like, may be used for controlling the inner, active convention loop.

In the outer convection loop, the pressure medium is cooled at the outer walls of the pressure vessel, i.e. at the inner surface of the pressure vessel, where the pressure medium flows towards the bottom of the pressing arrangement. At the bottom of the pressing arrangement, a portion of the pressure medium may be forced back into the furnace chamber, in which it is heated by the articles (or load) during rapid cooling.

In embodiments of the present invention, the heat insulated casing comprises a guiding passage formed between a housing part and a heat insulating portion, the guiding passage being arranged to guide pressure medium from the heat exchanger unit via the upper and/or lower inlets. In embodiments of the present invention, the guiding passage guides pressure medium towards a top of the pressure vessel or to towards a wall of the pressure vessel. This guiding passage will enhance the flow of pressure medium directed upwards during, for example, steady-state.

In an embodiment of the present invention, the at least one second inlet is arranged at the same height as the heat exchanger unit.

According to embodiments of the present invention, the heat exchanger unit is arranged above the at least one second inlet or lower inlets. By arranging the heat exchanger unit above the lower inlets, a flow of pressure medium through the heat exchanger unit and into the second guiding passage is created during the rapid cooling phase. Thereby, a more efficient and more rapid cooling process can be obtained due to the efficient thermal transfer from the pressure medium flowing descending through the heat exchanger unit.

In embodiments of the present invention, the heat exchanger unit is arranged substantially between the at least one first inlet and the at least one second inlet. Thereby, the heat exchanger unit can be held at a cold condition during steady-state and also during a moderate cooling phase. This entails that a rapid cooling can be achieved if desired at a low thermal load of the vessels walls since a rapid cooling phase can be initiated at a low initial temperature of the heat exchanger unit. Therefore, a significant thermal energy can be transferred to the heat exchanger unit from the pressure medium hence reducing the amount of thermal energy that has to be transferred to the walls of the vessel in order to reach a predetermined temperature of the pressure chamber.

According to embodiments of the present invention, the bottom insulating portion is arranged at substantially the same height as the at least one first inlet.

In embodiments of the present invention, a set of first or upper inlets are arranged at substantially the same height and a set of second or lower inlet are arranged below the upper set of inlets but at substantially the same height. The inlets of the set of first and second inlets may have different sizes, shapes, mutual distances (i.e. distances between two adjacent inlets), etc. Further, the inlet of the set of first and second inlets can be arranged according to a row pattern, a wave patter, a double row pattern, etc.

According to embodiments of the present invention, an opening cross-section area of the at least one first inlet is smaller than an opening cross-section area of the at least second inlet. In embodiments including more than one first inlet and more than one second inlet, the sum of the opening cross-section areas of the set or group of first inlets is smaller than the sum of the opening cross-section areas of the set or group of second inlets.

Thereby, a saturation of the first inlets (upper inlets) can be achieved while still maintain an efficient flow of pressure medium downwards through the heat exchanger unit and further into the second guiding passage during a rapid cooling phase. This entails that a more efficient and more rapid cooling process can be obtained due to the efficient thermal transfer from the pressure medium flowing descending through the heat exchanger unit.

In embodiments of the present invention, the at least one first inlet comprises a set of inlets arranged at substantially the same vertical location and wherein the at least one second inlet comprises a set of inlet arranged at substantially the same vertical location.

According to embodiments of the present invention, the heat exchanger unit is arranged such that a guiding passage is formed between the heat exchanger unit and the heat insulated casing.

The heat sink unit or heat exchanger unit is arranged completely inside the pressure vessel and is not supplied with any external cooling medium. Hence, the heat exchanger unit has no physical connection with the environment outside the pressure vessel.

The different embodiments of the present invention described herein can be combined, alone or in different combinations, with embodiments in different combinations described in the patent applications "Non-uniform cylinder" and " " filed on the same day as the present application by the same applicant. The content of the patent applications "Non-uniform cylinder" and "Improved outer cooling loop", respectively, are included herein by reference.

Other objectives, features and advantages of the present invention will appear from the following detailed description, the attached dependent claims, and from the appended drawings.

BRIEF DESCRIPTION OF THE DRAWINGS

The various aspects of the invention, including its particular features and advantages, will be readily understood from the following detailed description and the accompanying drawings. In the following Figures, like reference numerals denote like elements or features of embodiments of the present invention throughout. Further, reference numerals for symmetrically located items, elements or feature indicators are only denoted once in the Figures. On the drawings.

DETAILED DESCRIPTION OF EMBODIMENTS

Figure 1:
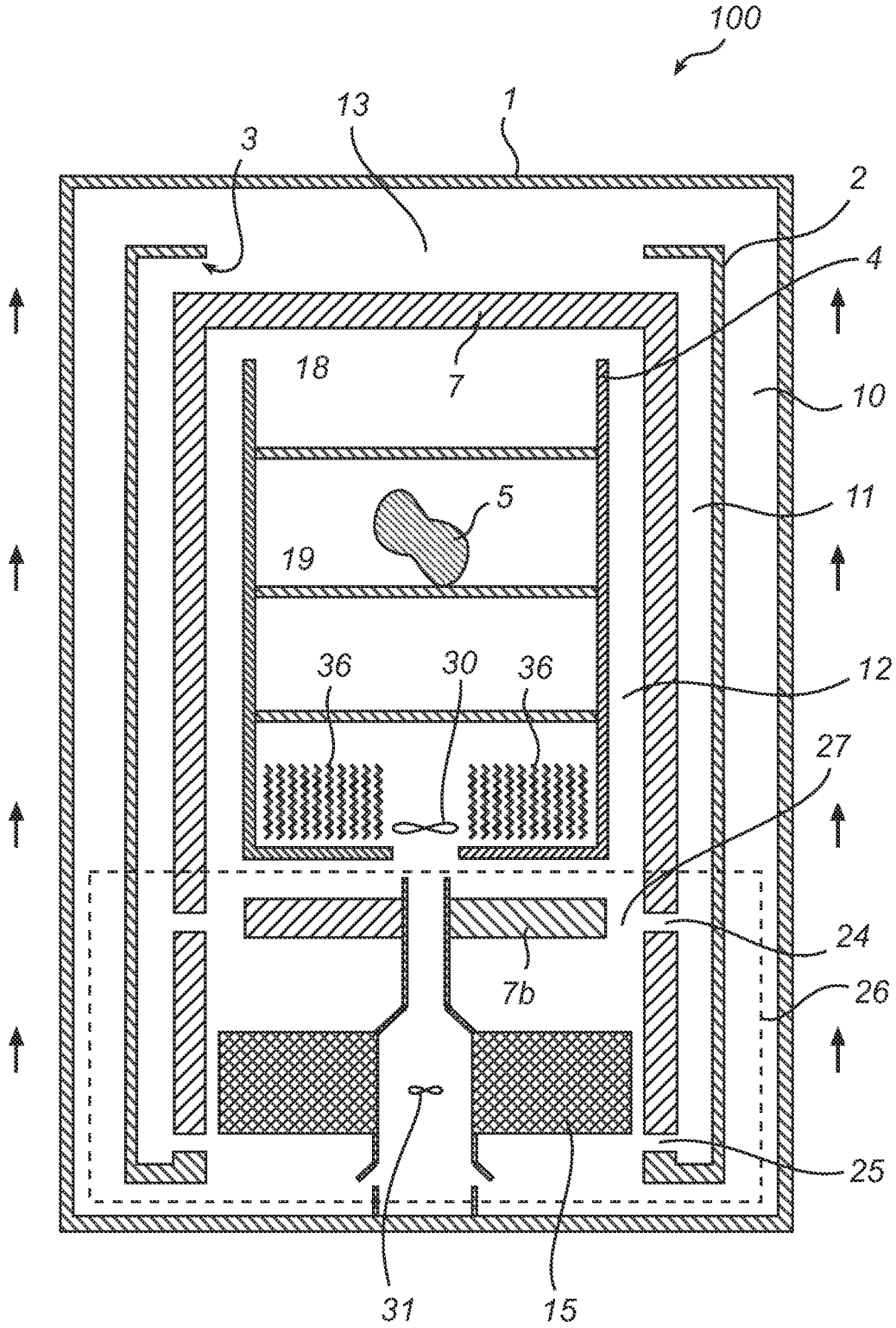
FIG. 1 is a side view of a pressing arrangement according to an embodiment of the invention.

The following is a description of exemplifying embodiments of the present invention. This description is intended for the purpose of explanation only and is not to be taken in a limiting sense. It should be noted that the drawings are schematic and that the pressing arrangements of the described embodiments may comprise features and elements that are, for the sake of simplicity, not indicated in the drawings.

Embodiments of the pressing arrangement according to the present invention may be used to treat articles made from a number of different possible materials by pressing, in particular by hot isostatic pressing.

FIG. 1 shows a pressing arrangement according to an embodiment of the invention. The pressing arrangement 100, which is intended to be used for pressing of articles, comprises a pressure vessel 1 with means (not shown), such as one or more ports, inlets and outlets, for supplying and discharging a pressure medium. The pressure medium may be a liquid or gaseous medium with low chemical affinity in relation to the articles to be treated. The pressure vessel 1 includes a furnace chamber 18, which comprises a furnace (or heater) 36, or heating elements, for heating of the pressure medium during the pressing phase of the treatment cycle. The furnace 36 may, as shown in for example FIG. 1, be located at the lower portion of the furnace chamber 18, or may be located at the sides of the furnace chamber 18. The person skilled in the art realises that it is also possible to combine heating elements at the sides with heating elements at the bottom so as to achieve a furnace which is located at the sides and at the bottom of the furnace chamber. Clearly, any implementation of the furnace regarding placement of heating elements, known in the art, may be applied to the embodiments shown herein. It is to be noted that the term "furnace" refers to the means for heating, while the term "furnace chamber" refers to the volume in which load and furnace are located. The furnace chamber 18 does not occupy the entire pressure vessel 1, but leaves an intermediate space 10 around it. During normal operation of the pressing arrangement 100, the intermediate space 10 is typically cooler than the furnace chamber 18 but is at equal pressure.

The furnace chamber 18 further includes a load compartment 19 for receiving and holding articles 5 to be treated. The furnace chamber 18 is surrounded by a heat insulated casing 3, which is likely to save energy during the heating phase. It may also ensure that convection takes place in a more ordered manner. In particular, because of the vertically elongated shape of the furnace chamber 18, the heat-insulated casing 3 may prevent forming of horizontal temperature gradients, which are difficult to monitor and control.

In the furnace chamber 18, there may also be located a fan 30 for circulating the pressure medium within the furnace chamber 18 and enhance an inner convection loop, in which pressure medium has an upward flow through the load compartment and a downward flow along a peripheral portion 12 of the furnace chamber.

Further, the pressure vessel 1 comprises a heat exchanger unit 15 located at the bottom of the pressure vessel 1, beneath the furnace chamber 18 as well as a bottom insulating portion 7*b*. The heat exchanger unit 15 is arranged to exchange, dissipate and/or absorb, thermal energy with the pressure medium.

The pressure vessel 1 may further comprise a fan 31, which is located beneath the furnace chamber 18, for guiding pressure medium into the furnace chamber.

Moreover, the outer wall of the pressure vessel 1 may be provided with channels or tubes (not shown), in which a coolant for cooling may be provided. In this manner, the vessel wall may be cooled in order to protect it from detrimental heat. The coolant is preferably water, but other coolants are also contemplated. The flow of coolant is indicated in FIG. 1 by the arrows on the outside of the pressure vessel.

Even though it is not shown in the figures, the pressure vessel 1 may be opened, such that the articles within the pressure vessel 1 can be removed. This may be realized in a number of different manners, all of which being apparent to a man skilled in the art.

A first guiding passage 10 is formed between the inside of the outer walls of the pressure vessel and the casing 3. The first guiding passage 10 is used to guide the pressure medium from the top of the pressure vessel 1 to the bottom thereof.

Further, the heat insulated casing 3 comprises a heat insulating portion 7 and a housing 2 arranged to surround the heat insulating portion 7, which thermally seals off the interior of the pressure vessel 1 in order to reduce heat loss.

Figure 8:
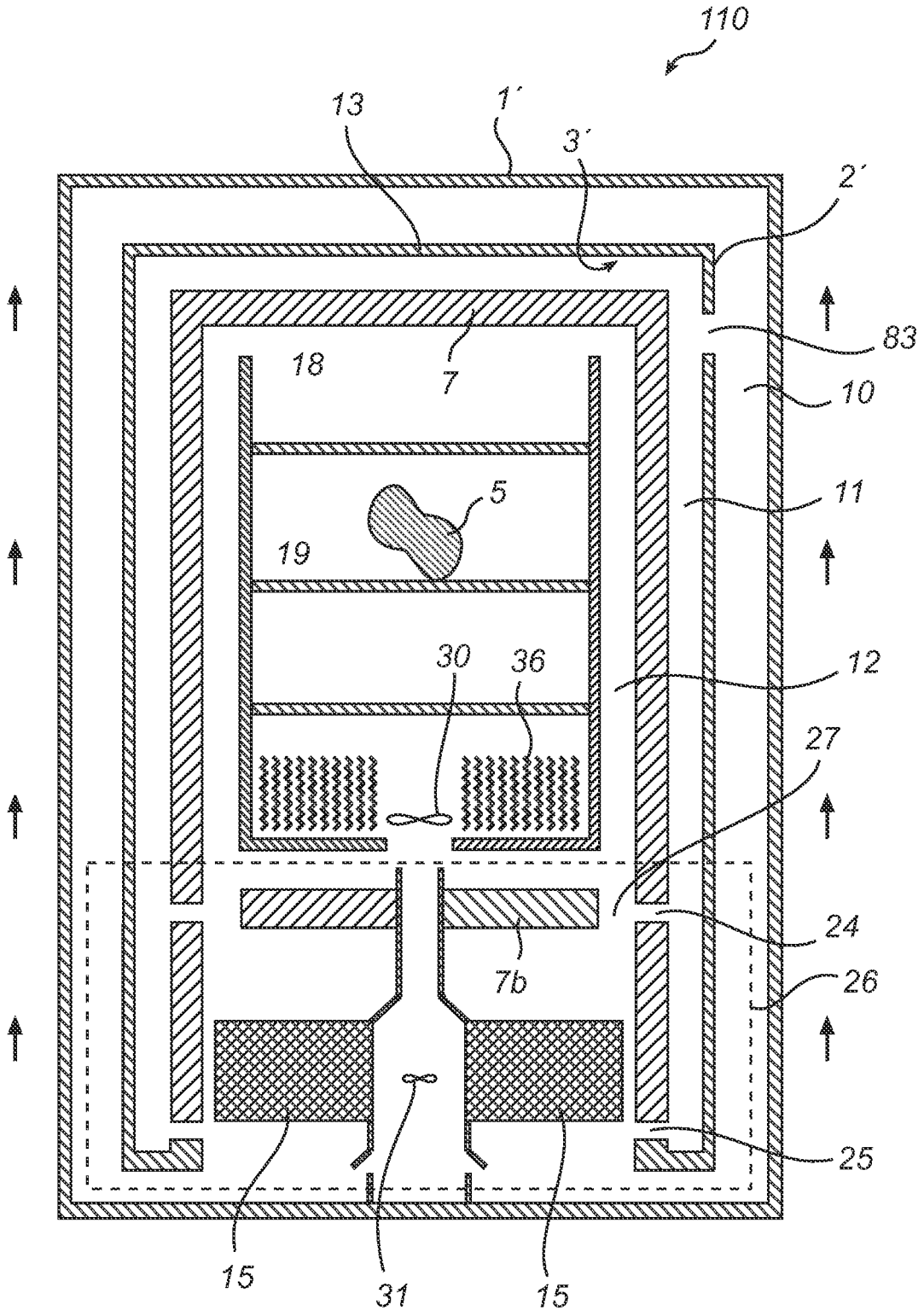
FIG. 8 is a side view of a pressing arrangement according to another embodiment of the invention.

Moreover, a second guiding passage 11 is formed between the housing 2 of the furnace chamber 18 and the heat insulating portion 7 of the furnace chamber 18. The second guiding passage 11 is used to guide the pressure medium towards the top of the pressure vessel. In FIG. 8, another embodiment of the present invention is illustrated where the second guiding passage guides the pressure medium to the pressure vessel wall, which will be discussed in more detail below.

The second guiding passage 11 is provided with at least a first inlet or upper inlet 24 and at least a second inlet or lower 25 for supplying pressure medium thereto, as well as an opening 13 at the top of the pressure vessel for allowing flow of the pressure medium into the first guiding passage 10. Preferably, the second guiding passage 11 is provided with a number of first inlets 24 and a number of second inlets 25 located at the approximately same vertical heights relatively to the heat exchanger unit 15, for example, arranged in rows. The first and second set of inlets 24, 25 are arranged in a lower part 26 of the heat insulated casing 3 adjacent to the heat exchanger unit 15.

According to embodiments of the present invention, a set of first or upper inlets are arranged in a row pattern a set of second or lower inlet are arranged below the upper set but in a row pattern. The inlets of the set of first and second inlets may have different sizes, shapes, mutual distances (i.e. distances between two adjacent inlets), etc. Further, the inlet of the set of first and second inlets can be arranged according to a row pattern, a wave patter, a double row pattern, etc.

According to embodiments of the present invention, an opening cross-section area of the at least one first inlet is smaller than an opening cross-section area of the at least second inlet. In embodiments including more than one first inlet and more than one second inlet, the sum of the opening cross-section areas of the set or group of first inlets is smaller than the sum of the opening cross-section areas of the set or group of second inlets.

Figure 6A:
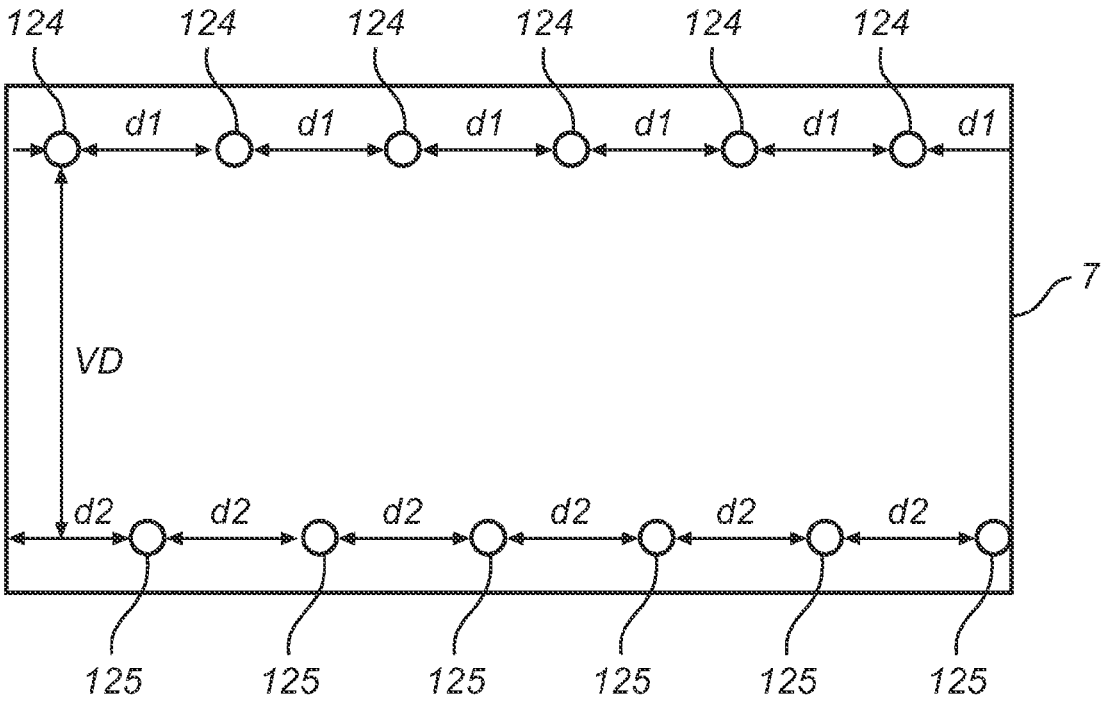
FIGS. 6*a* and 6*b* schematically show different inlet configurations of the upper and lower inlets.
Figure 6B:
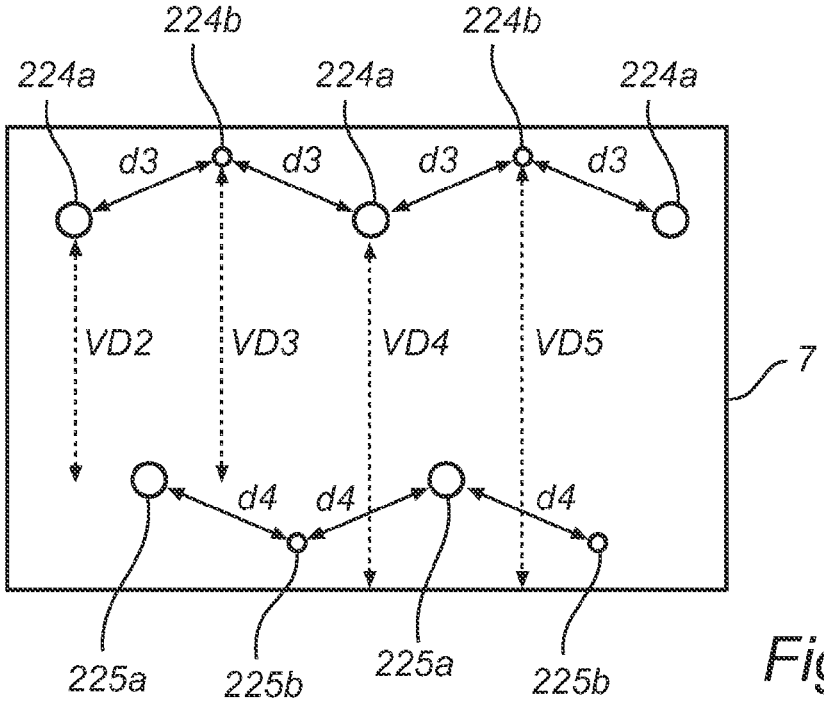

With reference to FIGS. 6*a*-6*b*, a number of different inlet configurations according to the present invention are shown. The figures are schematic and illustrates a part of the inside wall of the heat insulating portion 7 of the pressure vessel in rolled out condition. In FIG. 6*a*, one embodiment is shown where the inlets 124 of the upper set are circular with the same cross-sectional opening are and arranged with the same distance d1 between adjacent inlets and the inlets 125 of the lower set are circular with the same cross-sectional opening are and arranged with the same distance d2 between adjacent inlets. Further, the lower set of inlets 125 is arranged below the upper set of inlets 124 at a vertical distance VD. The upper set of inlets 124 is accordingly arranged at substantially a first vertical location within the pressure vessel and the second set of inlets 125 are arranged substantially at a second vertical location. As can be seen, an upper inlet 124 is not necessarily arranged directly vertically above a corresponding lower inlet 125 but may of course be arranged directly above the corresponding lower inlet. The total cross-section opening area of the lower inlets 125 (i.e. the sum of the individual opening areas) is bigger than the total cross-section opening area of the upper inlets 124.

In FIG. 6*b*, an embodiment is shown where the inlets 224*a*, 224*b* of the upper set has two different cross-section opening areas and are arranged according to a wave form shaped pattern with the same distance d3 between adjacent inlets and the inlets 225*a*, 225*b* of the lower set has two different cross-section opening areas and are arranged according to a wave form shaped pattern with the same distance d4 between adjacent inlets.

Further, the lower set of inlets 225*a*, 225*b* is arranged below the upper set of inlets 224*a*, 224*b* with vertical distances VD2, VD3, VD4, and VD5. The total cross-section opening area of the lower inlets 225*a*, 225*b* (i.e. the sum of the individual opening areas) is bigger than the total cross-section opening area of the upper inlets 224*a*, 224*b*. The lower set of inlets 225*a*, 225*b* comprises fewer inlets than the upper set 224*a*, 224*b*.

According to the present invention, the heat exchanger unit 15 is preferably arranged between upper set of inlets and the lower set of inlets, and thus, according to such preferred embodiments, have a height of about VD, if an inlet pattern configuration as shown in FIG. 6*a* is used, and a height of about VD2-VD5, if an inlet pattern configuration as shown in FIG. 6*b* is used.

Returning now to FIG. 1, the first inlets 24 are preferable arranged above the second inlets 25 and has a smaller total cross-section opening area than the second inlets 25. The heat exchanger unit 15 is preferable arranged at a position such that it is arranged between the first inlets 24 and the second inlets 25 as illustrated in FIG. 1 and below a bottom insulating portion 7*b*.

Between the bottom insulating portion 7*b* and the heat insulating portion 7, openings (or gaps) 27 are formed.

The first set of inlets 24 is preferably located at approximately the same height as the bottom insulating portion 7*b*, i.e. above the heat exchanger unit 15. An outer convection loop is thereby formed by the first and second guiding passages 10, 11 as well as in a lower portion, below the bottom insulating portion 7*b*, of the pressure vessel 1.

In some embodiments, the heat exchanger unit 15 is arranged such a third passage 34 is formed between the heat exchanger unit 15 and the casing 3.

Pressing of articles 5 in the pressing arrangement 100 according to FIG. 1 is substantially performed as described above.

Operation of an exemplary pressing arrangement in accordance with embodiments of the present invention will now be described generally.

In the following description, a treatment cycle may comprise several phases, such as loading phase, pressing and/or heating phase, cooling phase, rapid cooling phase, and unloading phase.

First, the pressure vessel 1 is opened such that the furnace chamber 18, and the load compartment 19 thereof, may be accessed. This can be accomplished in a number of different manners known in the art and no further description thereof is required for understanding the principles of the invention.

Then, the articles to be pressed are positioned in the load compartment 19 and the pressure vessel 1 is closed.

When the articles have been positioned in the load compartment 19 of the pressure vessel 1, pressure medium is fed into the pressure vessel 1, for instance by means of a compressor, a pressurized storage tank (a pressure supply), a cryogenic pump, or the like. The feeding of pressure medium into the pressure vessel 1 continues until a desired pressure is obtained inside the pressure vessel 1.

While, or after, feeding pressure medium into the pressure vessel 1, the furnace (the heating elements) 36 of the furnace chamber 18 is (are) activated and the temperature inside the load compartment is increased. If needed, the feeding of pressure medium continues and the pressure is increased until a pressure level has been obtained that is below the desired pressure for the pressing process, and at a temperature below the desired pressing temperature. Then, the pressure is increased the final amount by increasing the temperature in the furnace chamber 18, such that the desired pressing pressure is reached. Alternatively, the desired temperature and pressure is reached simultaneously or the desired pressure is reached after the desired temperature has been reached. A man skilled in the art realizes that any suitable method known in the art may be utilized to reach the desired pressing pressure and temperature. For instance, it is possible to equalize the pressure in the pressure vessel and a high pressure supply, and to then further pressurize the pressure vessel, by means of compressors, and further heat the pressure medium at the same time. An inner convention loop may be activated by the fan 30 included in the furnace chamber 18 in order to achieve an even temperature distribution.

In accordance with the embodiments described herein, the desired pressure is above approximately 200 bars, and the desired temperature is above approximately 400° C.

After a selected time period at which the temperature and pressure is maintained, i.e. the actual pressing phase, the temperature of the pressure medium is to be decreased, i.e. a phase of cooling is started. For embodiments of the pressing arrangement 100, the cooling phase may comprise, for example, one or more rapid cooling phases and/or a super rapid cooling phase, as described below.

The pressure medium used during the pressing phase can, when the temperature has been decreased enough, be discharged from the pressure vessel 1. For some pressure mediums, it may be convenient to discharge the pressure medium into a tank or the like for recycling.

After decompression, the pressure vessel 1 is opened such that the pressed articles 5 may be unloaded from the load compartment 19.

With reference now to FIGS. 2-5, different phases of the process, including steady-state and particularly a moderate and rapid cooling phase, will be explained in more detail. Again, the terms "hot" or "warm" and "cold" are to be interpreted in relation to an average temperature of the pressure medium within the pressure vessel. Further, the arrows indicate the flow direction of the pressure medium.

Figure 2:
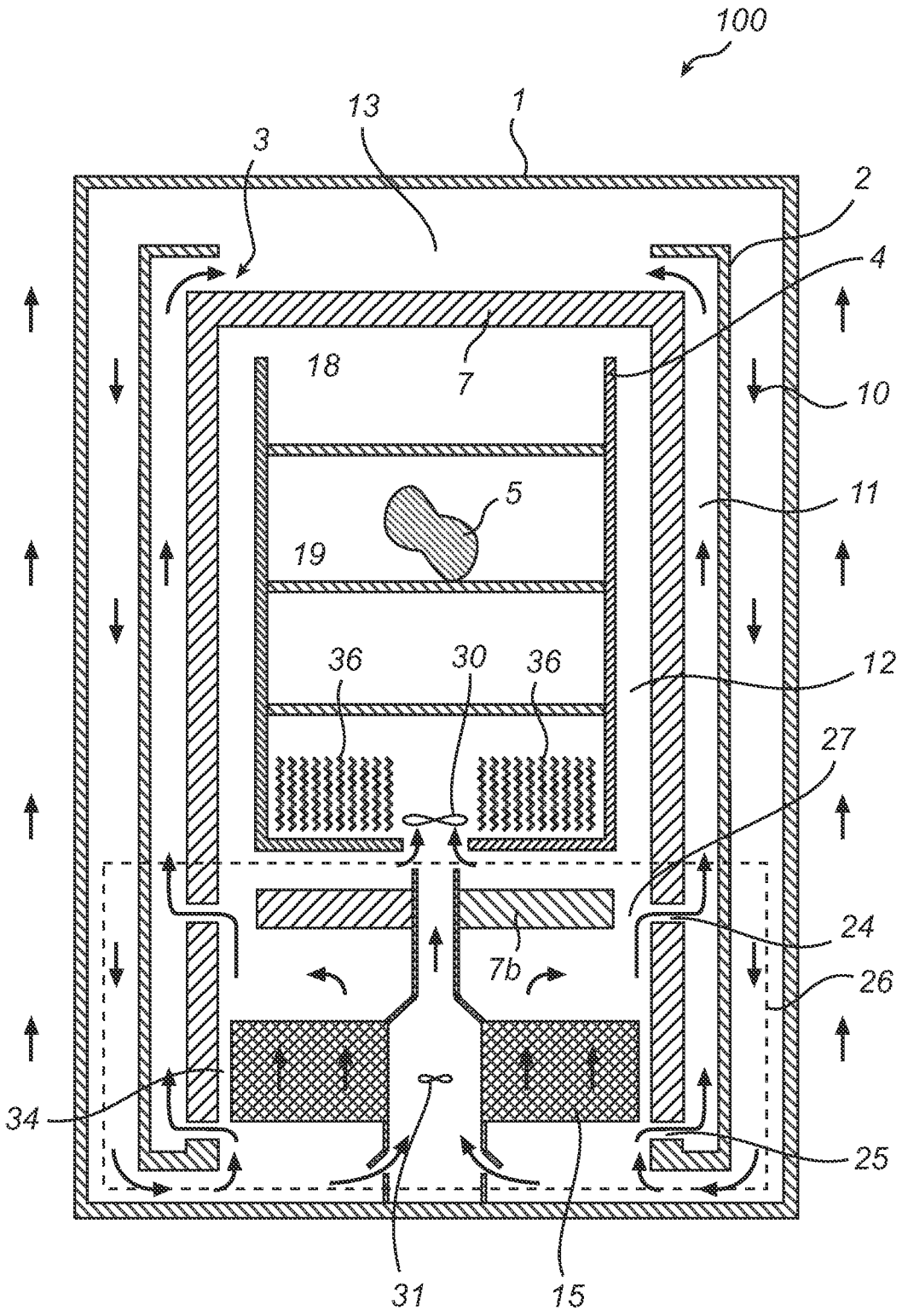
FIG. 2 is a side view of the pressing arrangement of FIG. 1 during a steady-state phase.

First, turning to FIG. 2, it is illustrated the flow directions of the pressure medium during steady-state. As can be seen, cold pressure medium that has passed downwards through the first guiding passage 10, ascends through the heat exchanger unit 15 and cools down the heat exchanger unit 15, or maintains it at a low temperature. A part of the cold pressure medium that has been passed downwards through the first guiding passage 10 flows through the second inlets 25 and into the second guiding passage 11. The pressure medium ascending through the heat exchanger unit 15 thereafter flows through the upper inlets 25 of the second guiding passage 11 and into the second guiding passage 11. The pressure medium in the second guiding passage 11 ascends and further through the opening 13. Thus, the upper inlets 24 are arranged with an opening area large enough to provide a through-flow during a steady-state or moderate cooling (as will be shown in FIG. 3) to thereby cool down the heat exchanger unit 15 or maintain it a low temperature.

Figure 3:
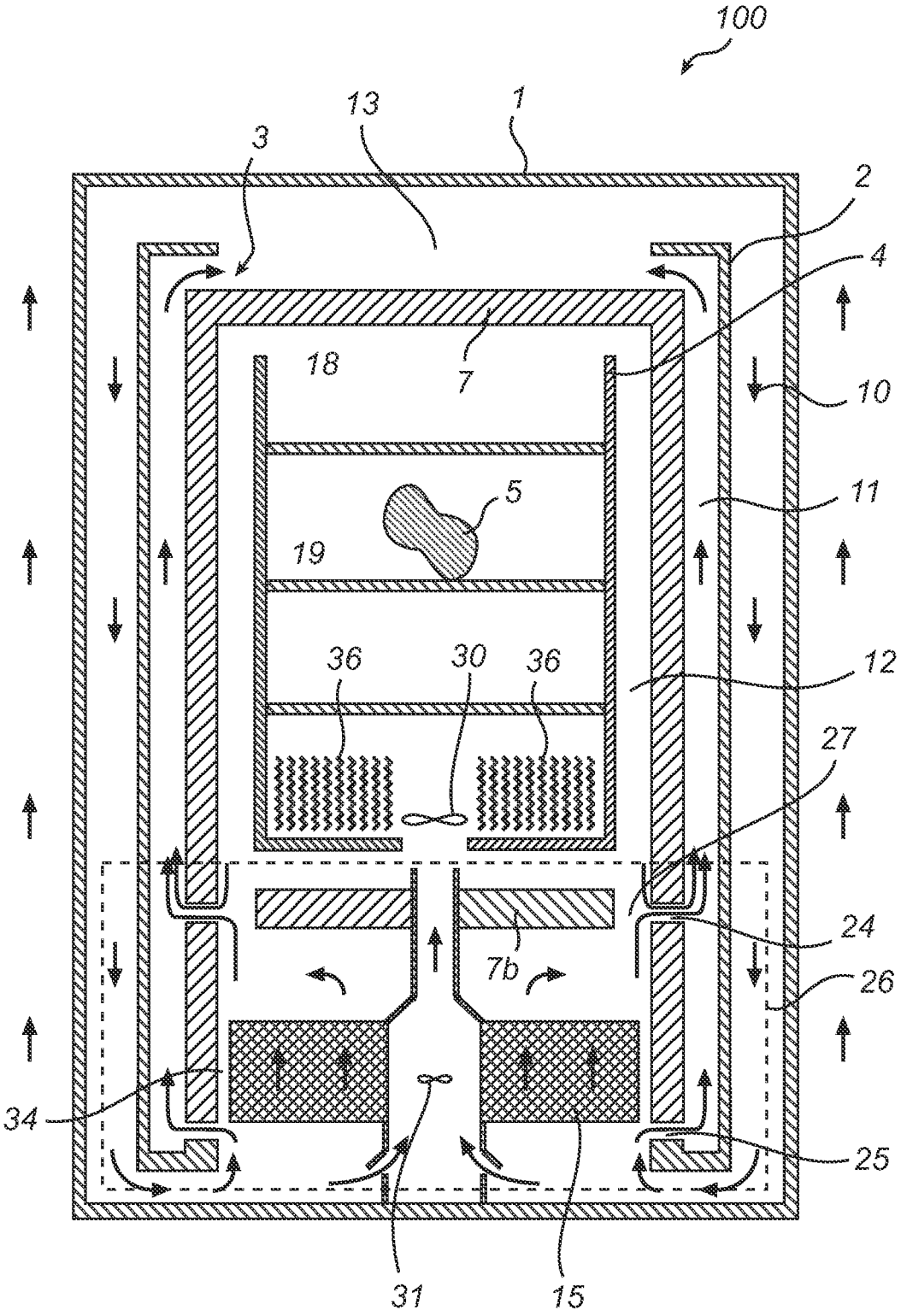
FIG. 3 is a side view of the pressing arrangement of FIG. 1 during a moderate cooling phase.

In FIG. 3, a moderate cooling phase is illustrated. During moderate cooling, the fans 31 and/or 30 are operated at a higher speed than during steady-state. As can be seen, cold pressure medium that has descended through the first guiding passage 10, thereafter ascends through the heat exchanger unit 15 and cools down the heat exchanger unit 15, or maintains it at a low temperature. A part of the cold pressure medium that has passed downwards through the first guiding passage 10 flows through the second inlets 25 and into the second guiding passage 11. The pressure medium ascending through the heat exchanger unit 15 thereafter flows through the upper inlets 25 of the second guiding passage 11 and into the second guiding passage 11. The pressure medium in the second guiding passage 11 ascends and further through the opening 13. However, during a moderate cooling phase, there will also be a flow downwards of warm pressure medium in the passage 12 and through the upper inlets 24. Thus, the upper inlets 24 are arranged with cross-section opening areas large enough to provide a through-flow also moderate cooling to thereby cool down the heat exchanger unit 15 or maintain it a low temperature. The flow of warm pressure medium downwards in the passage 12 and the flow of pressure medium upwards through the heat exchanger unit 15 both flow through the upper inlet 24 and thus compete of the available opening area of the inlet 24. If the flow of warm pressure medium is too high, the upper inlet 24 will be saturated and warm pressure medium will also start flowing downwards through the heat exchanger unit 15 and a cooling of the warm pressure medium can be achieved by a heat transfer from the warm pressure medium to the heat exchanger unit 15. The saturation point of the upper inlets 24 depend i.a. on the operational speed of the fans 30, 31 and the total cross-section opening area of the upper inlets 24.

Figure 4:
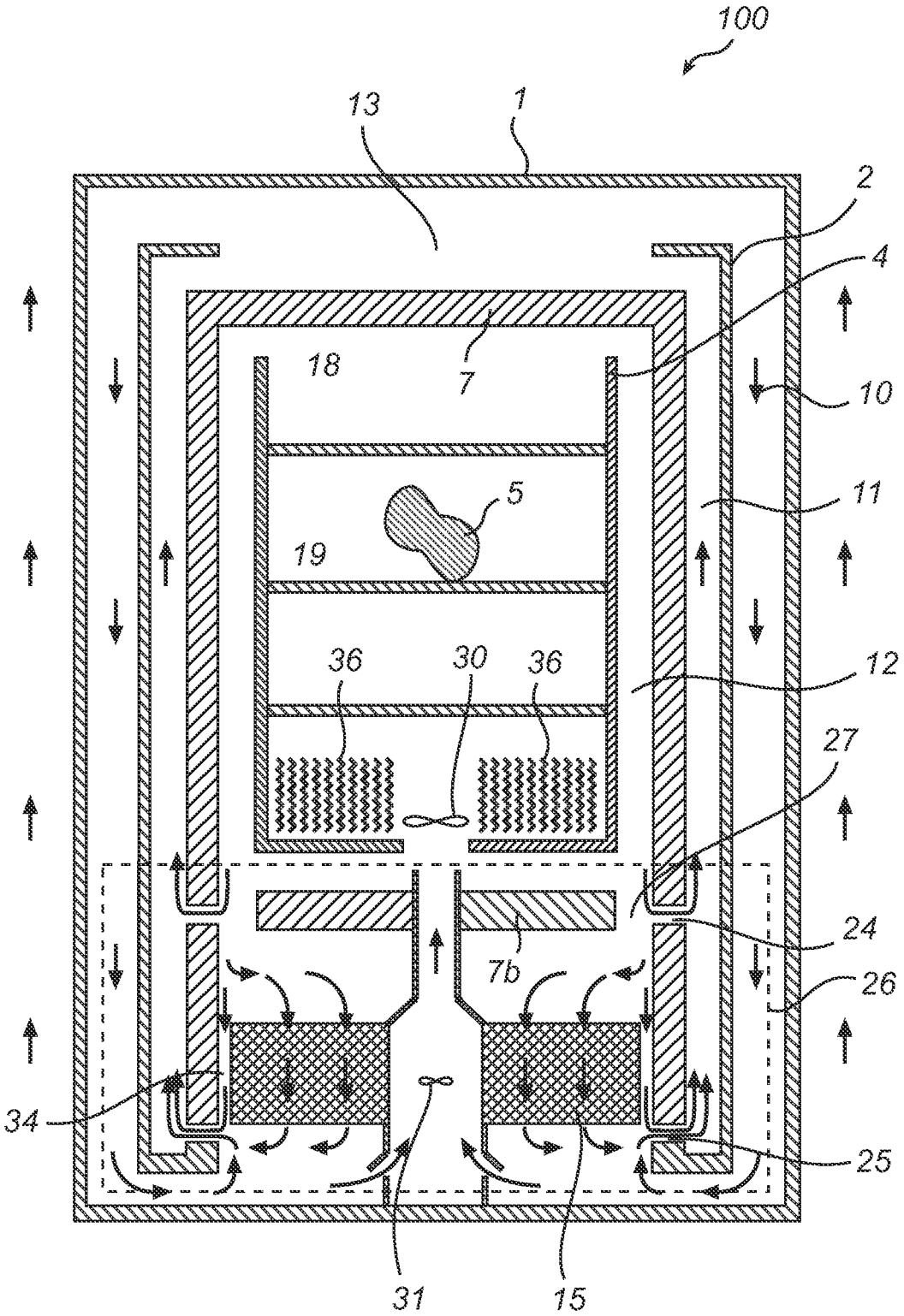
FIG. 4 is a side view of the pressing arrangement of FIG. 1 during a rapid cooling phase.

In FIG. 4, it is illustrated how the upper inlets are saturated during a rapid cooling phase. The upper inlets 24 are designed such that the outer wall of the pressure vessel 1 is not exposed to thermical overload or, in other words, the upper inlets 24 are designed (e.g. with respect to cross-section opening area and location relatively the bottom insulating portion **7*b* and the heat exchanger unit 15, and the lower inlets 25) such that the upper inlets 24 are saturated at a flow of warm pressure medium before a thermical overload of the outer wall of the pressure vessel 1** occurs.

With reference now to FIG. 4, a rapid cooling phase will be discussed. During rapid cooling, the fans 31 and/or 30 are operated at a very high speed significantly higher than during steady-state and during a moderate cooling phase. Warm pressure medium flowing downwards through the passage 12 flows through the upper inlets 24 and through the heat exchanger unit 15 because the upper inlets 24 have been saturated by the flow of warm pressure medium into the second guiding passage 11. The pressure medium flowing downwards through the heat exchanger unit 15 is cooled down by the heat exchanger unit 15 due to the transfer of heat or thermal energy from the pressure medium to the heat exchanger unit 15. The cooled pressure medium flowing out from the heat exchanger unit 15 thereafter enters into the second guiding passage 11 through the lower inlets 25. Cold pressure medium descending through the first guiding passage 10 flows into the second guiding passage 11 through the lower inlets 25. This entails that large amounts of heat or thermal energy can be transferred from the pressure medium to the heat exchanger unit 15 and at the same time as thermical overload of the outer wall of the pressure vessel 1 can be avoided.

Figure 5:
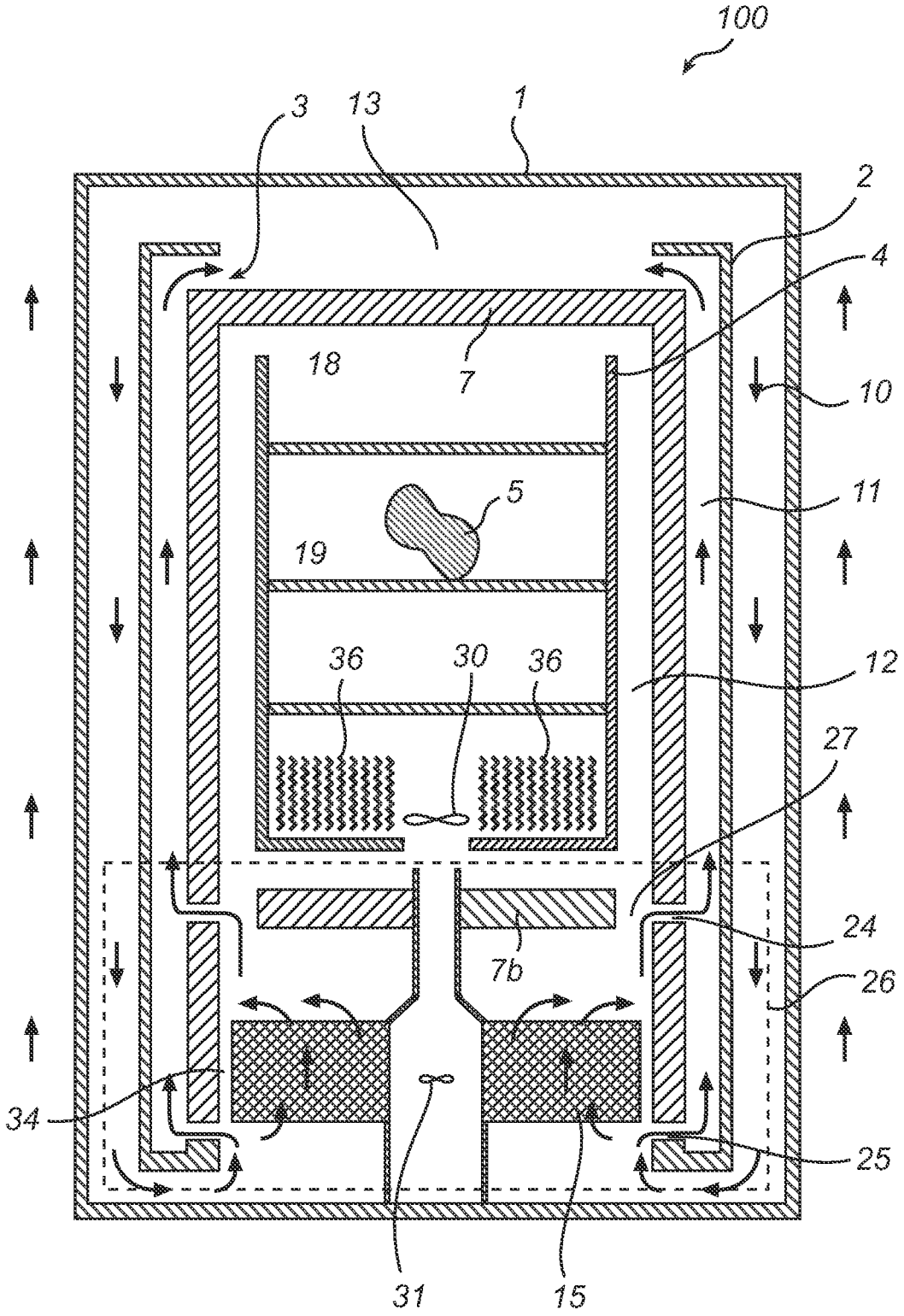
FIG. 5 is a side view of the pressing arrangement of FIG. 1 during a cooling phase of the heat exchanger unit.

In FIG. 5, it is illustrated how the heat exchanger unit 15 may be cooled down again after a rapid cooling phase. Alternatively, the heat exchanger unit 15 may be cooled down during steady-state of a subsequent process. If the rapid cooling process is interrupted at a suitable temperature, convection will cool down the heat exchanger unit 15. As can be seen, the cold pressure medium that has passed downwards through the first guiding passage 10 ascends through the heat exchanger unit 15 and cools the heat exchanger unit 15 down due to transfer of thermal energy from heat exchanger unit 15 to the pressure medium. Thereafter, warm pressure medium will enter into the second guiding passage 11 through the upper inlets 24 where it ascend and flows further through the opening 13. A part of the cold pressure medium that has passed downwards through the first guiding passage 10 flows through the second inlets 25 and into the second guiding passage 11.

Figure 7:
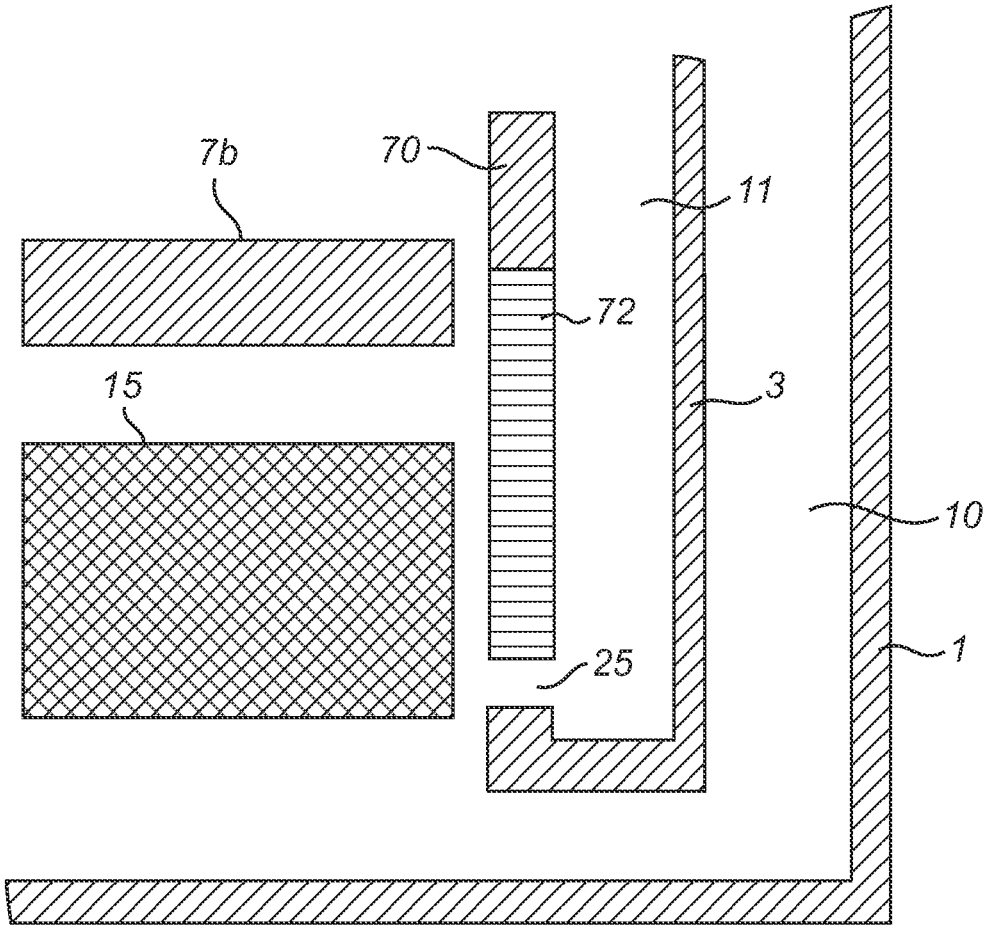
FIG. 7 schematically show a part of the press arrangement according to a further embodiment of the present invention.

With reference now to FIG. 7, another embodiment of the present invention will described. In FIG. 7, only a smaller part of the pressing arrangement is schematically shown. The same or corresponding part or element will be referred to with the same reference numerals as above and the description thereof will be omitted below. In this specific embodiment, an upper thermal inlet 72, i.e. a thermally permeable portion though which heat or thermal energy can pass but that not allow pressure medium to pass through, is arranged at approximately the same height as the bottom insulation portion 7*b* and the heat exchanger unit 15. The upper thermal inlet 72 is arranged in the heat insulation portion 70 and is made of a thermally permeable material. A lower inlet or set of inlets 25 are arranged below the thermally permeable portion 72 in accordance with the embodiments described above.

With reference now to FIG. 8, another embodiment of the present invention will described. The same or corresponding part or element will be referred to with the same reference numerals as above and the description thereof will be omitted below. In this specific embodiment of a pressing arrangement 110, the second guiding passage 11 formed between the housing 2' of the furnace chamber 18 and the heat insulating portion 7 of the furnace chamber 18. The second guiding passage 11 is used to guide the pressure medium towards the inner pressure vessel walls of the pressure vessel 1' through openings 83 of the heat insulated casing 3'.

Thus, the second guiding passage 11 is provided with at least a first inlet or upper inlet 24 and at least a second inlet or lower 25 for supplying pressure medium thereto, as well as openings 83 at the side of the heat insulated casing 3' (in the illustrated embodiment at the upper side) of the pressure vessel 1' for allowing flow of the pressure medium into the first guiding passage 10.

Even though the present description and drawings disclose embodiments and examples, including selections of components, materials, temperature ranges, pressure ranges, etc., the invention is not restricted to these specific examples. Numerous modifications and variations can be made without departing from the scope of the present invention, which is defined by the accompanying claims.

The invention claimed is:

1. A pressing arrangement for treatment of articles by hot pressing, comprising:

a pressure vessel comprising a furnace chamber comprising a heat insulated casing and a furnace adapted to hold the articles, the heat insulated casing comprising a heat insulating portion and a housing part, a heat exchanger unit arranged below said furnace chamber and adapted to exchange thermal energy with a pressure medium when the pressure medium is passing through said heat exchanger unit, a guiding passage, formed between the housing part and the heat insulating portion, for guiding the pressure medium, at least one first inlet arranged in said heat insulated casing at a lower part of said heat insulated casing, the at least one first inlet being provided in at least one first opening in the heat insulating portion for passage of the pressure medium into said guiding passage, and at least one second inlet arranged in said heat insulated casing at said lower part of said heat insulated casing, the at least one second inlet being provided in at least one second opening between the heat insulating portion and the housing part for passage of the pressure medium into said guiding passage, said at least second inlet being located below said heat exchanger unit in a vertical direction and in a flow direction of the pressure medium in the guiding passage during a cooling phase, said at least one first inlet being located above said heat exchanger unit in a vertical direction and in a flow direction of the pressure medium in the guiding passage during a cooling phase, and said at least one second inlet being arranged in relation to the at least one first inlet such that the at least one second inlet permits the pressure medium to pass into the guiding passage without having to pass through the at least one first inlet.

2. The pressing arrangement according to claim 1, wherein said guiding passage is arranged to guide pressure medium from said heat exchanger unit supplied via said at least first inlet and said at least second inlet.

3. The pressing arrangement according to claim 2, wherein said guiding passage is provided with at least one outlet for passing said pressure medium towards at least one of a top of said pressure vessel and side walls of said pressure vessel.

4. The pressing arrangement according to claim 1, wherein said heat exchanger unit is arranged between said at least one first inlet and said at least one second inlet.

5. The pressing arrangement according to claim 2, wherein said heat exchanger unit is arranged between said at least one first inlet and said at least one second inlet.

6. The pressing arrangement according to claim 1, wherein a bottom insulating portion is arranged below said furnace chamber and above said heat exchanger unit.

7. The pressing arrangement according to claim 6, wherein said bottom insulating portion is arranged at the same height as the at least one first inlet.

8. The pressing arrangement according to claim 6, wherein said bottom insulating portion is arranged substantially above said at least one first inlet.

9. The pressing arrangement according to claim 1, wherein the opening area of said at least one first inlet is smaller than the opening area of said at least one second inlet.

10. The pressing arrangement according to claim 2, wherein the opening area of said at least one first inlet is smaller than the opening area of said at least one second inlet.

11. The pressing arrangement according to claim 1, wherein a set of first inlets are arranged at substantially a first vertical location and wherein a set of second inlets are arranged at substantially a second vertical location.

12. The pressing arrangement according to claim 1, wherein said pressing arrangement is arranged for treatment of articles by hot isostatic pressing.

* * * * *